US009256208B2

(12) United States Patent
Hiranuma et al.

(10) Patent No.: US 9,256,208 B2
(45) Date of Patent: Feb. 9, 2016

(54) TIMEPIECE

(71) Applicant: Seiko Instruments Inc., Chiba-shi, Chiba (JP)

(72) Inventors: Haruki Hiranuma, Chiba (JP); Masahiro Ishida, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 14/489,184

(22) Filed: Sep. 17, 2014

(65) Prior Publication Data

US 2015/0085627 A1 Mar. 26, 2015

(30) Foreign Application Priority Data

Sep. 20, 2013 (JP) ..... 2013-195771

(51) Int. Cl.
*G04B 39/00* (2006.01)
*G04B 19/28* (2006.01)

(52) U.S. Cl.
CPC ..... *G04B 19/283* (2013.01)

(58) Field of Classification Search
CPC ..... G04B 19/283
USPC ..... 368/294, 295
See application file for complete search history.

(56) References Cited

U.S. PATENT DOCUMENTS 4,975,893 A * 12/1990 Dal Busco ..... 368/294
7,234,858 B2 * 6/2007 Meier ..... 368/294
8,864,369 B2 * 10/2014 Netuschill ..... 368/295
2001/0040840 A1 * 11/2001 Terasawa et al. ..... 368/295
2002/0021624 A1 * 2/2002 Hiranuma et al. ..... 368/294
2003/0099165 A1 * 5/2003 Terasawa ..... 368/294
2004/0141424 A1 * 7/2004 Hartmann et al. ..... 368/295
2005/0007890 A1 * 1/2005 Bertrand et al. ..... 368/294
2006/0193210 A1 * 8/2006 Damasko ..... 368/295
2010/0220561 A1 * 9/2010 Takeda ..... 368/295

FOREIGN PATENT DOCUMENTS

CH 707500 A2 * 7/2014
DE 3100791 A1 * 8/1982
JP 2003-43162 A 2/2003
WO WO 2007105043 A2 * 9/2007

OTHER PUBLICATIONS

Porsche et al., English Translation of DE 3100791, Aug. 5, 1982, full document.*

* cited by examiner

*Primary Examiner* — Amy Cohen Johnson
*Assistant Examiner* — Daniel Wicklund
(74) *Attorney, Agent, or Firm* — Brinks Gilson & Lione

(57) ABSTRACT

The present invention is to provide a timepiece. The time piece comprises a ring-shaped mounting member formed of an elastic material and positioned between the annular shell and the ring-shaped bezel. The ring-shaped mounting member includes an engaging portion having a second engagement surface configured to engage with a first engagement surface formed in the annular shell to restrict the ring-shaped bezel from moving relative to the annular shell in a first axial direction to prevent the ring-shaped bezel from separating from the annular shell. The ring-shaped mounting member is deformable with a force, so that the second engagement surface can slide along the first engagement surface to release ring-shaped bezel from the annular shell.

5 Claims, 12 Drawing Sheets

TIMEPIECE

RELATED APPLICATIONS

This application claims priority under 35 U.S.C. §119 to Japanese Patent Application No. 2013-195771 filed on Sep. 20, 2013, the entire content of which is hereby incorporated by reference.

BACKGROUND OF THE INVENTION

1. Field of the Invention

The present invention relates to a timepiece such as a portable timepiece including a bezel that can be rotatively operated.

2. Description of the Related Art

A timepiece to which a bezel rotatively operated by a user is mounted to a shell of a case is known in related arts (for example, refer to JP-A-2003-43162 (Patent Literature 1)).

In the timepiece disclosed in Patent Literature 1, the bezel is mounted to the shell so as to be freely rotated by locking a locked flange portion provided continuously around an inner peripheral surface of the bezel to a locking flange portion provided continuously around an outer peripheral surface of a rising portion included in the shell. Here, both the bezel and the shell are made of a metal, and these flange portions are locked by pressing the bezel onto the case with a strong force of a pressing machine and so on to thereby allow the locked flange portion to climb over to a lower part of the locking flange portion. Accordingly, the bezel is prevented from falling off from the case.

Additionally, in the timepiece disclosed in Patent Literature 1, a packing material made of an elastic member is interposed between the outer peripheral surface of the rising portion and the inner peripheral surface of the bezel as well as on the upper side of the locking flange portion. The bezel is held in a still state by the packing material so as not to be flipped. As such packing material is used, the rotation of the bezel is allowed in the case where the user gives a rotation torque exceeding a given degree by the operation of rotating the bezel.

When sand particles enter, or dirt is heaped between the shell and the bezel, the rotation operation of the bezel may be heavy (not smooth). Moreover, deterioration of the packing material proceeds with a lapse of time, the rotation operation of the bezel may be heavy as the deteriorated packing material may stick to the shell and the bezel if the rotation operation is not performed for a long period of time.

In the maintenance for correcting the above situation, after the bezel is removed from the shell once, the shell and the bezel are cleaned, or the packing material is replaced, then, the bezel is mounted to the shell again. To remove the bezel from the shell in the maintenance, a disassembly tool is inserted between the bezel and the shell, and the bezel is pried off by using this tool. The mounting of the cleaned bezel to the shell is performed by pressing the bezel onto the shell with a strong force.

The deformation of the locking flange portion of the shell made of a metal and the locked flange portion of the bezel made of a metal is not easy. Accordingly, as the locking flange portion of the shell and the locked flange portion of the bezel compete with each other with the mounting and removal of the bezel as described above, these flange portions are scraped. Therefore, there is a problem that, as the number of times of removing and mounting the bezel is increased, the engagement allowance between the locking flange portion and the locked flange portion is reduced and the bezel is easily removed from the shell.

There is another problem in the related art timepiece that a dedicated packing material is necessary not only for engaging between the locking flange portion and the locked flange portion for holding the state where the bezel is mounted to the shell but also for preventing the wobble of the bezel and for regulating the rotation operation torque.

SUMMARY OF THE INVENTION

An object of the present invention is to provide a timepiece capable of maintaining the reliability for holding the state where the bezel is mounted to the shell as well as capable of preventing the wobble of the bezel and for regulating rotation operation torque without using the dedicated packing material even when the bezel is removed for the maintenance.

In order to solve the above problems, there is provided a timepiece including a case including a shell having an annular convex portion and an engaging projection formed at an outer periphery of the annular convex portion so as to extend in a circumferential direction, a ring-shaped bezel having an inner peripheral concave portion surrounding the outer periphery of the annular convex portion and arranged so as to be rotatively operated while covering the outer periphery of the annular convex portion and a ring-shaped mounting member including an outer peripheral portion arranged in the inner peripheral concave portion, an inner peripheral portion with an annular groove enabling elastic deformation in directions close to and away from the outer peripheral portion formed between the inner peripheral portion and the outer peripheral portion, which is continued from the outer peripheral portion, and an engaging portion formed in the inner peripheral portion, capable of being engaged with and disengaged from the engaging projection with the elastic deformation of the inner peripheral portion, which maintains an engaged state between the engaging projection and the engaging portion by an elastic force of the inner peripheral portion.

In the present invention, the shell is preferably made of a metal, and the bezel may be made of a metal or a synthetic resin. The mounting member is preferably an integral molded part of an elastic material, for example, a synthetic resin having elasticity in the present invention. The mounting member may be fixed to the inner peripheral concave portion of the bezel by using an adhesive at the outer peripheral portion thereof. Moreover, the mounting member may be held by the bezel so as to relatively move in a rotation direction of the bezel or may be positioned in the bezel so as to be integrally rotated with the bezel in a state where the outer peripheral portion and so on contact the inner peripheral concave portion of the bezel as described in the embodiment in the present invention.

In order to mount the bezel to the shell in the timepiece according to the present invention, the bezel is assembled to the case so that the mounting member surrounds the outer periphery of the annular convex portion included in the shell in the state where the mounting member is held in the inner peripheral concave portion of the bezel in advance. Accordingly, the engaging portion of the mounting member climbs over the engaging projection of the annular convex portion and immediately after that, the engaging portion is engaged with the engaging projection in a state of being caught from a root side of the annular convex portion, thereby mounting the bezel to the shell. In order to remove the bezel from the shell in maintenance, it is preferable to add an external force for removing the bezel artificially to the bezel. Accordingly, the engaging portion caught by the engaging projection of the annular convex portion can climb over the engaging projection to thereby remove the bezel from the shell.

When the engaging portion climbs over the engaging projection by the mounting/removal of the bezel, the inner peripheral portion of the mounting member is elastically deformed so as to come close to the outer peripheral portion. The deformation can be realized as the annular groove is formed between the inner peripheral portion and the outer peripheral portion. As the inner peripheral portion having the engaging portion is elastically deformed as described above, the engaging portion climbs over the engaging projection while escaping therefrom. Accordingly, it is possible to suppress the engaging portion and the engaging projection to be scraped by competition between them whether the strength between the engaging portion and the engaging projection is the same or different from each other.

Furthermore, the inner peripheral portion of the mounting member sandwiched by the shell and the bezel holds the elastically-deformed state while the bezel is mounted to the bezel by the procedures described above. Accordingly, the engaging portion is elastically pressed to the annular convex portion by the elastic force of the inner peripheral portion as well as a reaction force thereof is added to the bezel, thereby holding the bezel in a still state.

In the timepiece according to the embodiment of the present invention, the mounting member may include plural grooves communicated to the annular groove, and the inner peripheral portion may be divided into plural portions in a circumferential direction of the mounting member by the grooves.

In the embodiment, the inner peripheral members divided into plural portions are not affected by the inner peripheral members adjacent to each other with the grooves interposed therebetween, therefore, elastic deformation can be performed more easily when the bezel is mounted to and removed from the shell. Accordingly, the mounting/removal of the bezel with respect to the shell can be performed more easily.

Also in the timepiece according to the embodiment of the present invention, the bezel and the outer peripheral portion may be fitted in a convexo-concave manner so that the mounting member does not move in a thickness direction of the bezel.

In the embodiment, the convexo-concave fitting means that the concave portion provided in any one of the bezel and the outer peripheral portion is fitted to the convex portion provided in the other of them. Additionally, plural convex portions and concave portions may be provided.

Since the mounting member is held so as not to move in the thickness direction of the bezel by the convexo-concave fitting in the embodiment, it is not necessary to fix the mounting member to the bezel by using an adhesive or a fixing member for holding the mounting member. As the mounting member is not fixed to the bezel, the mounting member can be rotated at a different angle from the rotation angle of the bezel when the mounting member is rotated in accordance with the rotation operation of the bezel. Additionally, since the mounting member can be removed from the bezel, the mounting member can be replaced in the maintenance.

Also in the timepiece according to the embodiment of the present invention, the bezel may include at least one hole opening to the inner peripheral concave portion, the mounting member may include a projection of the same number as the hole, and the projection and the hole may be fitted to each other.

Since the hole of the bezel is fitted to the projection of the mounting member in the embodiment, the mounting member can be rotated at the same rotation angle as the bezel when the mounting member is rotatively operated.

The timepiece according to the embodiment of the present invention may further includes a click stop means for holding the bezel in an arbitrary rotation position, in which the click stop means may include a click engaging portion formed by plural projections and depressions formed side by side in the circumferential direction of the mounting member on an end surface of the outer peripheral portion which faces the shell, and a click member pressed onto the click engaging portion by an elastic force, which is engaged with and disengaged from the click engaging portion.

In the embodiment, the click member can be pressed to the click engaging portion by the elastic force of the coil spring prepared in addition to the click member. When the click member is formed by a blade spring instead of the above, it is possible to press the click member to the click engaging portion by the elastic force of the click member itself.

The mounting member the rotation thereof is restricted with respect to the bezel doubles as part of the click stop member in the timepiece in which the mounting member is rotated at the same rotation angle as the bezel in the embodiment, therefore, positional relationship between indications added to the surface of the bezel and the click engaging portion is properly held without being shifted regardless of the rotation operation of the bezel.

According to the invention, it is possible to prevent the engaging projection of the shell and the engaging portion of the mounting member engaged with the projection to thereby hold the bezel in the shell from being scraped and to suppress the reduction of the engagement allowance thereof even when the bezel is mounted and removed for maintenance, therefore, reliability in holding the state where the bezel is mounted to the shell can be maintained. Additionally, as the mounting member is sandwiched by the shell and the bezel in the state where the inner peripheral portion of the mounting member is elastically deformed, there is an advantage that the wobble of the bezel can be prevented and a rotation operation torque can be regulated without using a dedicated packing material.

DETAILED DESCRIPTION OF THE PREFERRED EMBODIMENTS

A first embodiment of the present invention will be explained with reference to FIG. 1 to FIG. 7.

Figure 1:
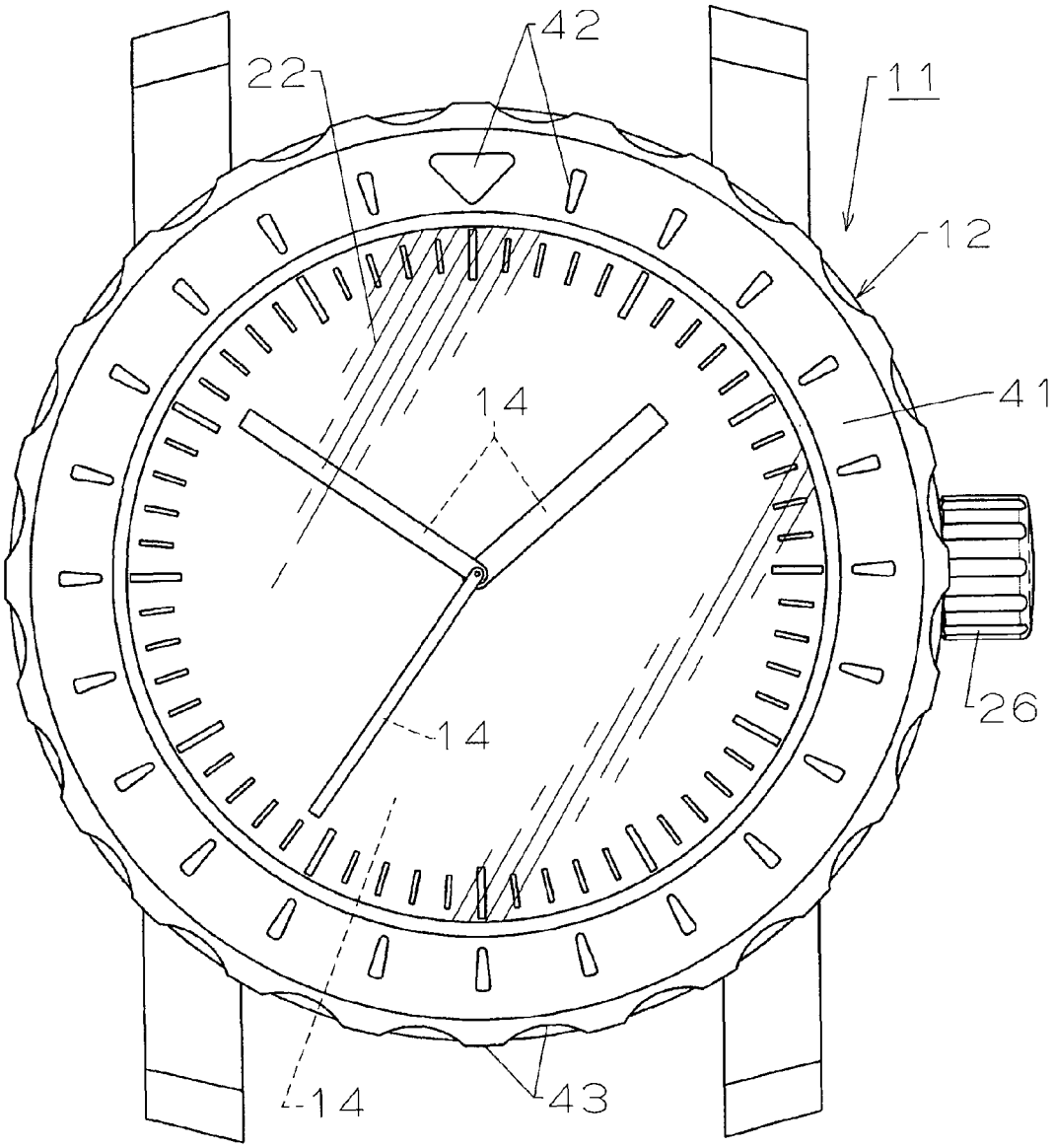
FIG. 1 is a front view showing a watch according to a first embodiment of the present invention.
Figure 2:
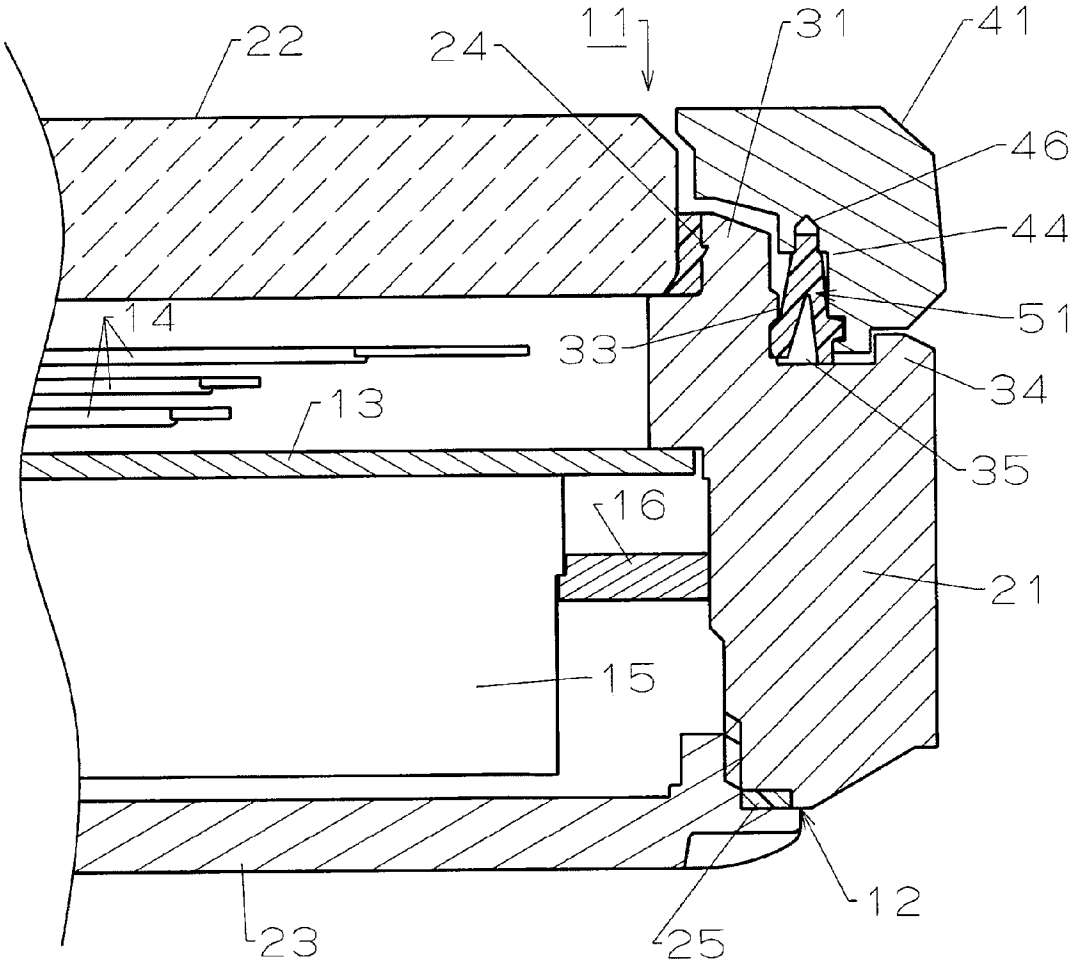
FIG. 2 is a cross-sectional view showing part of the watch of FIG. 1.

A reference numeral 11 in FIG. 1 and FIG. 2 denotes a timepiece, for example, a portable timepiece, specifically, a watch such as a diver's watch. The watch 11 is provided with a case 12 forming an outer package.

As shown in FIG. 2, required members such as a display plate, for example, a dial 13, a device for controlling the display of the hour and so on, for example, a movement 15 for controlling the motion of hands 14 for displaying the hour and so on are accommodated in a case 12. A reference numeral 16 in FIG. 2 denotes a middle frame supporting the movement 15.

Figure 3:
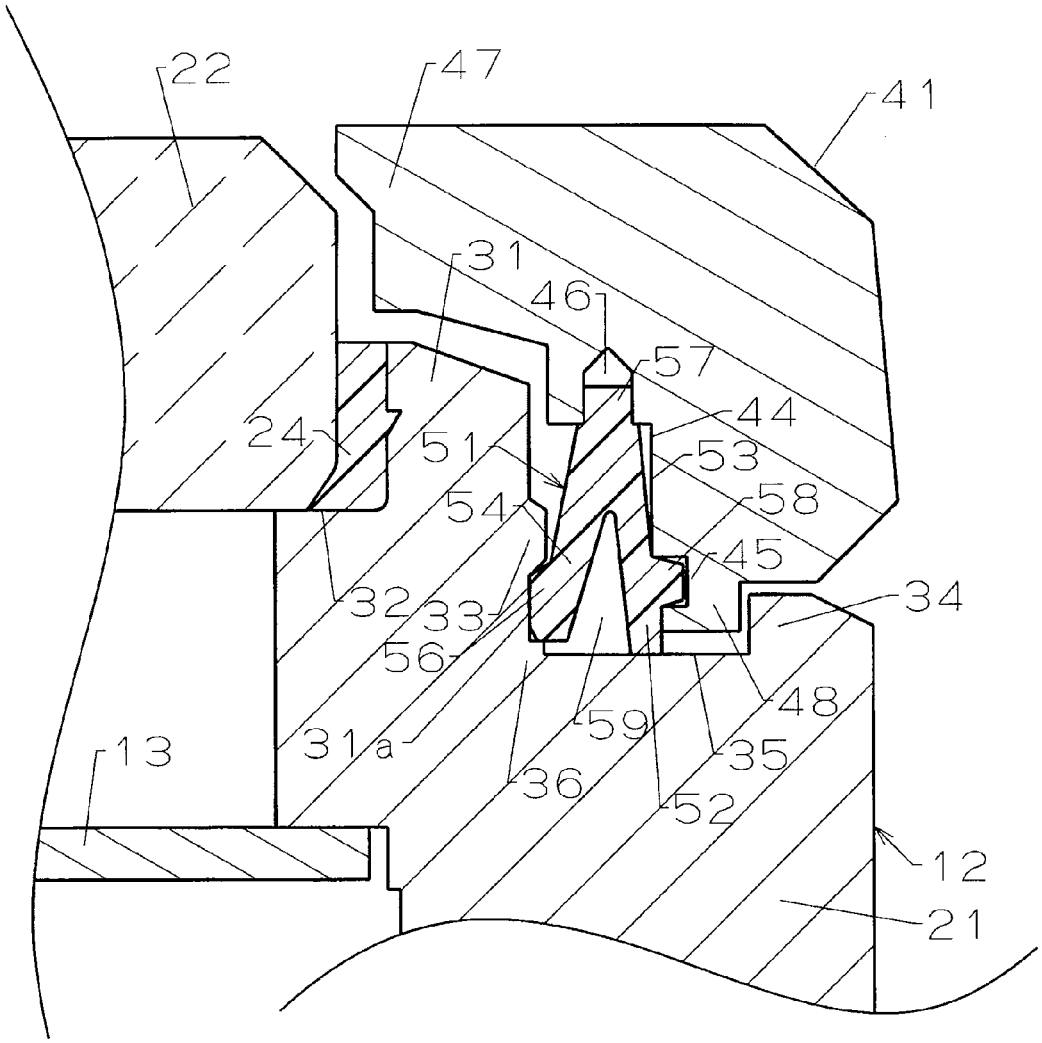
FIG. 3 is a view obtained by cross-sectioning a bezel mounting structure of the watch of FIG. 1 at a position passing an engaging projection of a mounting member.
Figure 4:
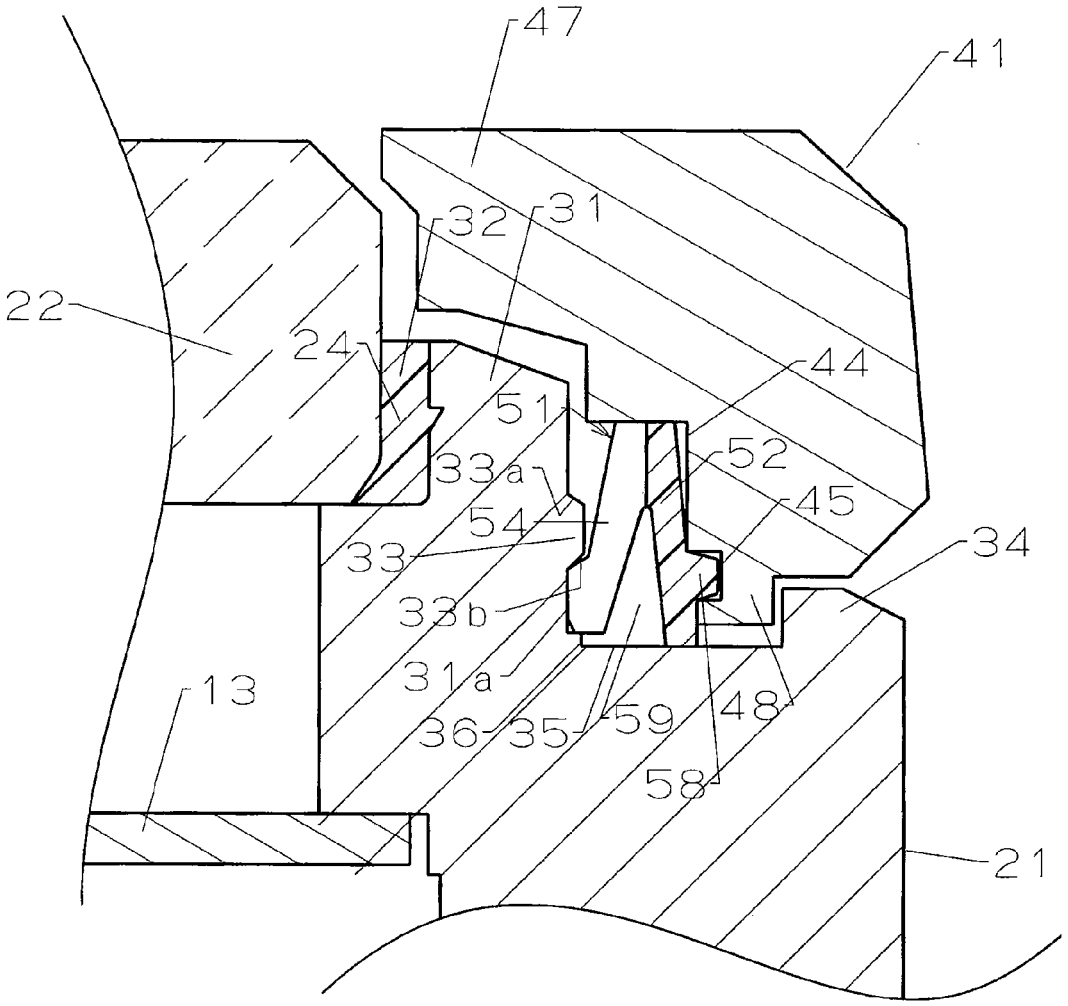
FIG. 4 is a view obtained by cross sectioning a bezel mounting structure of the watch of FIG. 1 at a position passing a groove of the mounting member.

As shown in FIG. 2 to FIG. 4, the case 12 is formed by fixing a circular see-through cover 22 to be a front surface of the watch 11 in a liquid-tight manner on one face of the shell 21 formed in a ring shape in a thickness direction, and by fixing a back lid 23 to be a back surface of the watch 11 in a liquid-tight manner on the other face of the shell 21 in the thickness direction. The shell 21 is made of a metal such as stainless steel and titanium, and the back lid 23 is made of a metal or a synthetic resin. The see-through cover 22 is made of a translucent member, for example, a transparent glass or the like, through which the dial 13 can be seen. Respective reference numerals 24 and 25 in FIG. 2 to FIG. 4 denote packing formed in a ring shape by a sealing material for holding liquid tightness of the case 12. A reference numeral 26 in FIG. 1 denotes a crown.

As shown in FIG. 2 to FIG. 4, the shell 21 has an annular convex portion 31 protruding to the front side of the case 12. The annular convex portion 31 has a support concave portion 32 formed in an opened state at a tip and an inner periphery thereof. A back surface of the periphery of the see-through cover 22 contacts a bottom surface of the support concave portion 32, and the see-through cover 22 is fixed to the inner side of the annular convex portion 31 in a liquid-tight manner through the packing 24 interposed between a peripheral surface of the see-through cover 22 and the support concave portion 32. Accordingly, the annular convex portion 31 is provided so as to surround the see-through cover 22.

An engaging projection 33 is formed in an outer periphery of the annular convex portion 31. The engaging projection 33 extends in a circumferential direction of the annular convex portion 31 and is formed continuously around, for example, the outer periphery of the annular convex portion 31. The projecting size of the engaging projection 33 is preferably, for example, (0.6±0.1) mm.

As shown in FIG. 4, the engaging projection 33 includes a first slope 33*a* and a second slope 33*b*. The first slope 33*a* is a surface closer to the tip of the annular convex portion 31 than the second slope 33*b* with respect to a root of the annular convex portion 31, which is inclined so that the engaging projection 33 comes close to the root side of the annular convex portion 31 as being inclined toward a tip surface side thereof. The second slope 33*b* is a surface closer to the root of the annular convex portion 31 than the first slope 33*a* with respect to the root of the annular convex portion 31, which is inclined so that the engaging projection 33 gets away from the root side of the annular convex portion 31 as being inclined toward a tip surface side thereof. Therefore, the engaging projection 33 is formed in a tapered shape. The second slope 33*b* is used as an engaging surface.

The shell 21 has a convex portion 34 and a concave groove 35 surrounding the root portion of the annular convex portion 31. The convex portion 34 protrudes to the front side of the case 12 to be formed in a ring shape. The concave groove 35 is sectioned by the convex portion 34 and the annular convex portion 31 to be formed in a ring shape, opening to the front side of the case 12. The shell 21 has an annular step portion 36 at a corner portion between the concave groove 35 and the root portion of the annular convex portion 31. Accordingly, an annular engaging concave portion 31*a* (refer to FIG. 4) sectioned by the annular step portion 36 and the engaging projection 33 is formed on a peripheral surface of the annular convex portion 31.

A bezel 41 is disposed on the front surface side of the case 12 so as to be rotatively operated. As shown in FIG. 1, the bezel 41 has a ring shape an inner diameter of which is larger than that of the see-through cover 22. The bezel 41 has given indications 42 on the surface thereof. Additionally, projections and depressions 43 for preventing fingers of the operator from slipping when the bezel is rotatively operated by the user are formed around the bezel 41.

The bezel 41 is made of, for example, the same kind of metal as the shell 21, including an inner peripheral concave portion 44, a fitting concave portion 45, at least one hole 46, a cover portion 47 and an insertion convex portion 48 as shown in FIG. 3 and FIG. 4.

The inner peripheral concave portion 44 is formed continuously around the bezel 41 in a circumferential direction as well as opens to an inner space surrounded by the bezel 41 and a back surface of the bezel 41. The fitting concave portion 45 is formed continuously around the bezel 41 in the circumferential direction as well as opens to a vertical surface sectioning the inner peripheral concave portion 44 along a thickness direction of the bezel 41.

The hole 46 is provided so as to open to the inner peripheral concave portion 44. Specifically, the hole 46 is provided so as to open to a horizontal surface bending continuously from the vertical surface and sectioning the inner peripheral concave portion 44. The horizontal surface may be a slope as well as may be a surface with a step. Although only one hole 46 is shown, two holes are provided 180 degrees apart from each other in the circumferential direction of the bezel 41 in the present embodiment. When plural holes 46 are provided, they are provided apart from each other at equal intervals in the circumferential direction of the bezel 41. It is also possible to provide the holes 46 so as to open to the vertical surface.

The cover portion 47 is a portion which protrudes to the center side of the bezel 41 with respect to the inner peripheral concave portion 44 to define the minimum inner diameter of the bezel 41 as well as to cover the tip of the annular convex portion 31. The insertion convex portion 48 is a portion having a ring shape and formed on the back surface of the bezel 41 to be inserted into part of the concave groove 35.

As shown in FIG. 2 to FIG. 4, a mounting member 51 is held in the bezel 41 so as not to fall off therefrom, and the bezel 41 is mounted to the shell 21 through the mounting member 51 so as to be rotatively operated.

Figure 5:
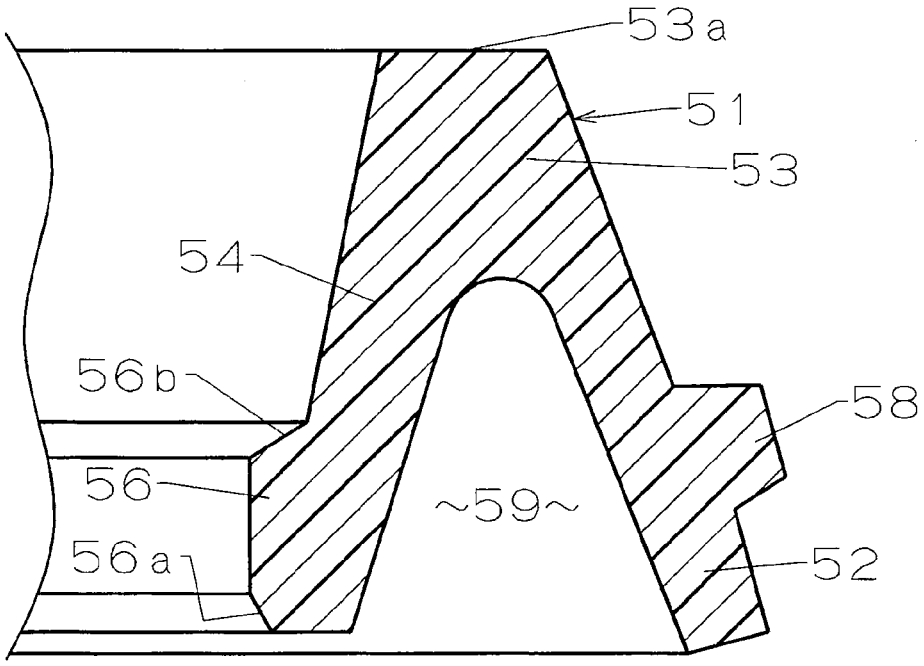
FIG. 5 is a cross-sectional view showing part of the mounting member included in the watch of FIG. 1.
Figure 6:
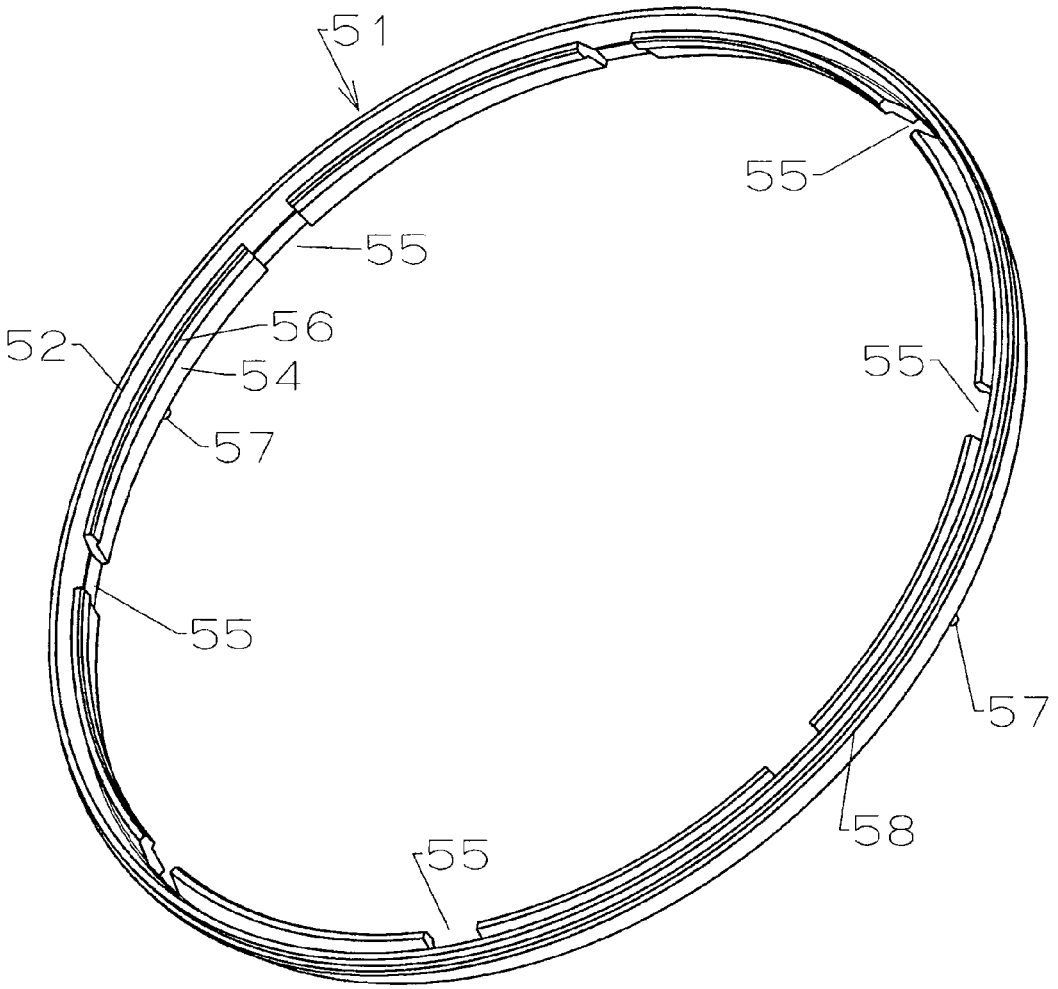
FIG. 6 is a perspective view showing the mounting member included in the watch of FIG. 1 seen from the back side.
Figure 7:
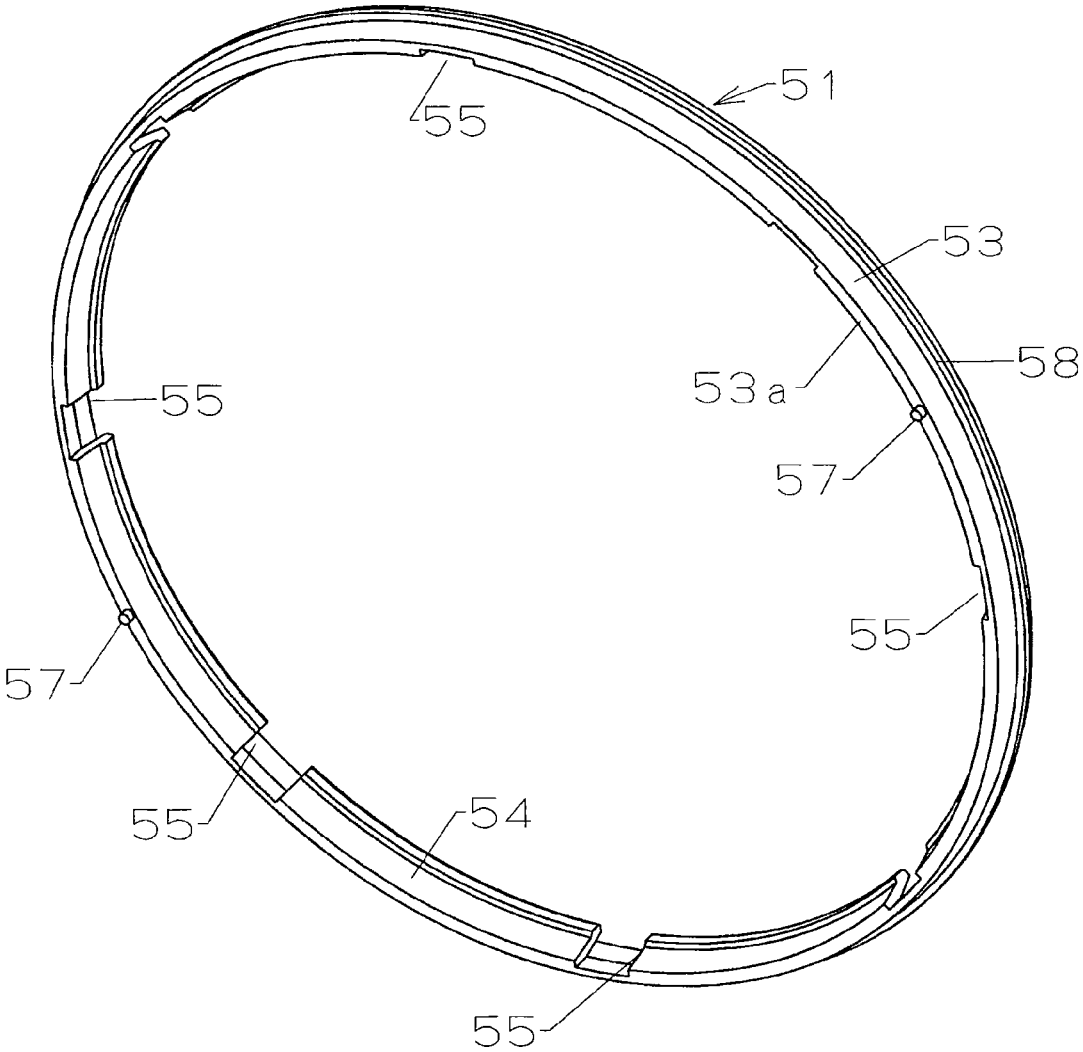
FIG. 7 is a perspective view showing the mounting member included in the watch of FIG. 1 seen from the front side.

The mounting member 51 is an integral molded part made of a material which can be elastically deformed, for example, a synthetic resin such as plastic having elasticity, which is formed in a ring shape as shown in FIG. 6 and FIG. 7. As shown in FIG. 3 to FIG. 7, the mounting member 51 includes an outer peripheral portion 52, a base portion 53, an inner peripheral portion 54, grooves 55, an engaging portion 56, projections 57 and a fitting convex portion 58.

The outer peripheral portion 52 is a portion disposed in the inner peripheral concave portion 44 so as to contact the vertical surface sectioning the inner peripheral concave portion 44. The fitting convex portion 58 protrudes from the outer periphery of the outer peripheral portion 52. The fitting convex portion 58 is formed continuously around the outer peripheral portion 52. The fitting convex portion 58 is a portion to be fitted to the fitting concave portion 45.

The base portion 53 is formed so as to be continued from the outer peripheral portion 52. The base portion 53 has a flat surface 53*a* contacting the horizontal surface sectioning the inner peripheral concave portion 44, and the projections 57 project from the flat surface 53*a* with the same number and the same positions as the holes 46. The projections 57 are portions to be fitted to the holes 46.

The inner peripheral portion 54 is continued from the based portion 53 with an annular groove 59 formed between the inner peripheral portion 54 and the outer peripheral portion 52. Therefore, the inner peripheral portion 54 and the outer peripheral portion 52 are connected to each other through the base portion 53. As shown in FIG. 5, the width of the annular groove 59 is gradually increased as getting away from the base portion 53.

A length of the inner peripheral portion 54 is shorter than a length of the outer peripheral portion 52. The inner peripheral portion 54 is divided into plural portions in a circumferential direction of the mounting member 51 by the plural grooves 55 communicated to the annular groove 59 and provided at equal intervals in the circumferential direction of the mounting member 51 as shown in FIG. 6 and FIG. 7. The inner peripheral portion 54 can be elastically deformed in directions to be close to and away from the outer peripheral portion 52, and the elastic deformation is allowed by the annular groove 59. Moreover, as the inner peripheral portion 54 is divided into plural portions by respective grooves 55, elastic deformation can be further facilitated.

The engaging portion 56 protrudes at a tip portion of the inner peripheral portion 54 as well as to a side surface not facing the outer peripheral portion 52. The engaging portion 56 is formed continuously around the inner peripheral portion 54. The engaging portion 56 is a portion to be fitted to the engaging concave portion 31*a* of the shell 21 as well as to be engaged to the second slope 33*b* of the engaging projection 33 from the root portion of the annular convex portion 31.

As shown in FIG. 5, the engaging portion 56 includes a slope-state surface 56*a* and an engaging surface 56*b*. The slope-state surface 56*a* is formed in a slope or an arc surface. The engaging surface 56*b* is formed in a slope similar to the second slope 33*b* of the engaging projection 33.

The mounting member 51 is mounted to the bezel 41 by fitting respective projections 57 to the holes 46 of the bezel 41 respectively as well as by convexo-concave fitting the fitting convex portion 58 to the fitting concave portion 45 of the bezel 41. The mounting state is shown in FIG. 3 and FIG. 4. The mounting member 51 can be held so as not to move in the thickness direction of the bezel 41 by the above convexo-concave fitting. Accordingly, it is not necessary to use an adhesive or a fixing member to maintain the fixing state of the mounting member 51 with respect to the bezel 41.

In the above mounting state, the outer peripheral portion 52 of the mounting member 51 is disposed in the inner peripheral concave portion 44 of the bezel 41. The outer periphery of the outer peripheral portion 52 contacts the vertical surface sectioning the inner peripheral concave portion 44 in a vertically standing state without being adhered to the vertical surface, and the flat surface 53*a* of the base portion 53 contacts the horizontal surface sectioning the inner peripheral concave portion 44 without being adhered to the horizontal surface.

Furthermore, the tip of the outer peripheral portion 52 protrudes from the back surface of the bezel 41 in the mounting state. Additionally, the inner peripheral portion 54 of the mounting member 51 is inclined with respect to the outer peripheral portion 52 in the mounting state.

The mounting member 51 is held by fitting the fitting convex portion 58 to the fitting concave portion 45 so as not to fall off from the bezel 41. Moreover, the mounting member 51 is held so as not to move in the thickness direction of the bezel 41 by the contact of the flat surface 53*a* to the horizontal surface and the above convexo-concave fitting. The mounting member 51 is positioned by fitting the projections 57 to the holes 46 so as not to move in the circumferential direction of the bezel 41.

The bezel 41 is mounted to the shell 21 through the mounting member 51 held in the above manner. The operation is performed by covering the annular convex portion 31 with the bezel 41 so that the mounting member 51 surrounds at least the outer periphery of the annular convex portion 31 of the shell 21 and pressing the bezel 41.

In this case, first, the inner peripheral portion 54 is elastically deformed in a direction coming close to the outer peripheral portion 52 as the engaging portion 56 of the mounting member 51 contacts the outer periphery of the annular convex portion 31. The engaging portion 56 contacts the engaging projection 33 of the annular convex portion 31 as the pressing of the bezel 41 proceeds, therefore, the inner peripheral portion 54 is further elastically deformed. Accordingly, the engaging portion 56 climbs over the engaging projection 33.

At this time, the first slope 33*a* of the engaging projection 33 contacts the slope-state surface 56*a* of the engaging portion 56. Accordingly, the pressing of the bezel 41 is not stopped by the engaging portion 56 being caught by the engaging projection 33. Additionally, the inner peripheral portion 54 is divided into plural portions by respective grooves 55 and can be elastically deformed easily. Therefore, the engaging portion 56 can climb over the engaging protrusion 33 easily by a guide operation of the first slope 33*a* and the slope-state surface 56*a*.

Just after the engaging portion 56 climbs over the engaging protrusion 33, the tip of the outer peripheral portion 52 of the mounting member 51 contacts a bottom surface of the concave groove 35. Accordingly, the movement by pressing of the bezel 41 is stopped.

In addition to the above, the engaging portion 56 enters the engaging concave portion 31*a* of the annular convex portion 31 as the inner peripheral portion 54 is restored toward an obliquely upper left direction in FIG. 3 due to the elastic force just after the climbing, and the engaging surface 56*b* of the engaging portion 56 is engaged with the second slope (engaging surface) 33*b* of the engaging protrusion 33 in a state of being caught from the root side of the annular convex portion 31. Accordingly, the bezel 41 is positioned in the thickness direction of the case 12 to be mounted to the shell 21. It is preferable that the outer peripheral portion 52 which contacts the bottom surface of the concave groove 35 is elastically deformed in the above mounting state, because the engagement between the engaging portion 56 and the engaging protrusion 33 becomes more stable, and the mounting state of the bezel 41 becomes more stable.

According to the above mounting, the insertion convex portion 48 of the bezel 41 enters the concave groove 35 of the shell 21 and is fitted to the inner periphery of the convex portion 34. Accordingly, the bezel 41 is prevented from moving in a radial direction of the shell 21. Moreover, the cover portion 47 of the bezel 41 covers the tip surface of the annular convex portion 31 formed in the shell 21 and is arranged so as to be close to a peripheral edge of the see-through cover 22. It is also preferable to allow the tip surface of the annular convex portion 31 to be exposed between the inner periphery of the cover portion 47 and the peripheral edge of the see-through cover 22 by omitting the cover portion 47 or shortening the protruding width of the bezel 41 to the center direction.

In the state where the bezel 41 is mounted to the shell 21 as described above, the mounting member 51 is sandwiched between the annular convex portion 31 of the shell 21 and the bezel 41 and the inner peripheral portion 54 holds the elastic deformation. Accordingly, the engaging portion 56 is elastically pressed to the outer periphery of the annular convex portion 31 due to the elastic force of the inner peripheral portion 54 as well as a reaction force thereof is added to the bezel 41.

Due to the reaction force, the bezel 41 is held so as not to wobble in the radial direction. Additionally, a rotation operation force of the bezel 41 is regulated by a frictional engagement force between the outer periphery of the annular convex portion 31 and the inner peripheral portion 54 elastically contacts thereof. The prevention of wobble of the bezel 41 and the regulation of the rotation operation force of the bezel 41 can be realized by using the mounting member 51 without requiring a dedicating part for realizing them.

In the present embodiment, the projections 57 of the mounting member 51 are respectively fitted to the two holes 46 of the bezel 41. Therefore, when the bezel 41 is rotatively operated by the user, the mounting member 51 is rotated around the annular convex portion 31 at the same rotation angle as the bezel 41.

In the case of performing maintenance of the periphery of the bezel 41, an external force that can remove the bezel 41 may be added to the bezel 41 for removing the bezel 41 from the shell 21.

Accordingly, the inner peripheral portion 54 of the mounting member 51 is elastically deformed in the direction of coming close to the outer peripheral portion 52. In this case, as the inner peripheral portion 54 is shorter than the outer peripheral portion 52 in accordance with the height of the annular step portion 36 of the shell 21, the tip does not contact and rub the bottom surface of the concave groove 35 in accordance with the elastic deformation of the inner peripheral portion 54. Therefore, it is certain that the inner peripheral portion 54 is elastically deformed.

When the engaging portion 56 climbs over the engaging projection 33 of the annular convex portion 31 in accordance with the elastic deformation of the inner peripheral portion 54, the bezel 41 is removed from the shell 21. At this time, the engaging portion 56 can easily climb over the engaging projection 33 by a guide operation of the second slope 33*b* of the engaging projection 33 and the engaging surface 56*b* of the engaging portion 56. Furthermore, the inner peripheral portion 54 is divided into plural portions by respective grooves 55 and can be elastically deformed more easily.

The bezel 41, the annular convex portion 31 of the shell 21 and the mounting member 51 are cleaned in a state where the bezel 41 is removed, maintenance of the periphery of the bezel 41 can be performed. Moreover, the mounting member 51 can be replaced in addition to the cleaning if necessary, which enables the maintenance around the bezel 41.

As described above, when the bezel 41 is mounted to and removed from the shell 21, the engaging portion 56 of the mounting member 51 climbs over the engaging projection 33 of the annular convex portion 31. At this time, the inner peripheral portion 54 of the mounting member 51 is elastically deformed so as to be close to the outer peripheral portion 52. In other words, the engaging portion 56 climbs over the engaging projection 33 while escaping therefrom with the elastic deformation of the inner peripheral portion 54 having the engaging portion 56. Accordingly, it is possible to suppress the engaging portion 56 and the engaging projection 33 to be scraped whether the strength between them is the same or different from each other even though the engaging portion 56 and the engaging projection 33 compete each other at the time of mounting and removing the bezel 41.

Therefore, the reduction of engagement allowance between the engaging portion 56 and the engaging projection 33 in the state where the bezel 41 is mounted to the shell 21 can be suppressed. As a result, the reliability in holding the state where the bezel 41 is mounted to the shell 21 can be maintained even when the mounting/removal of the bezel 41 are repeated.

Figure 8:
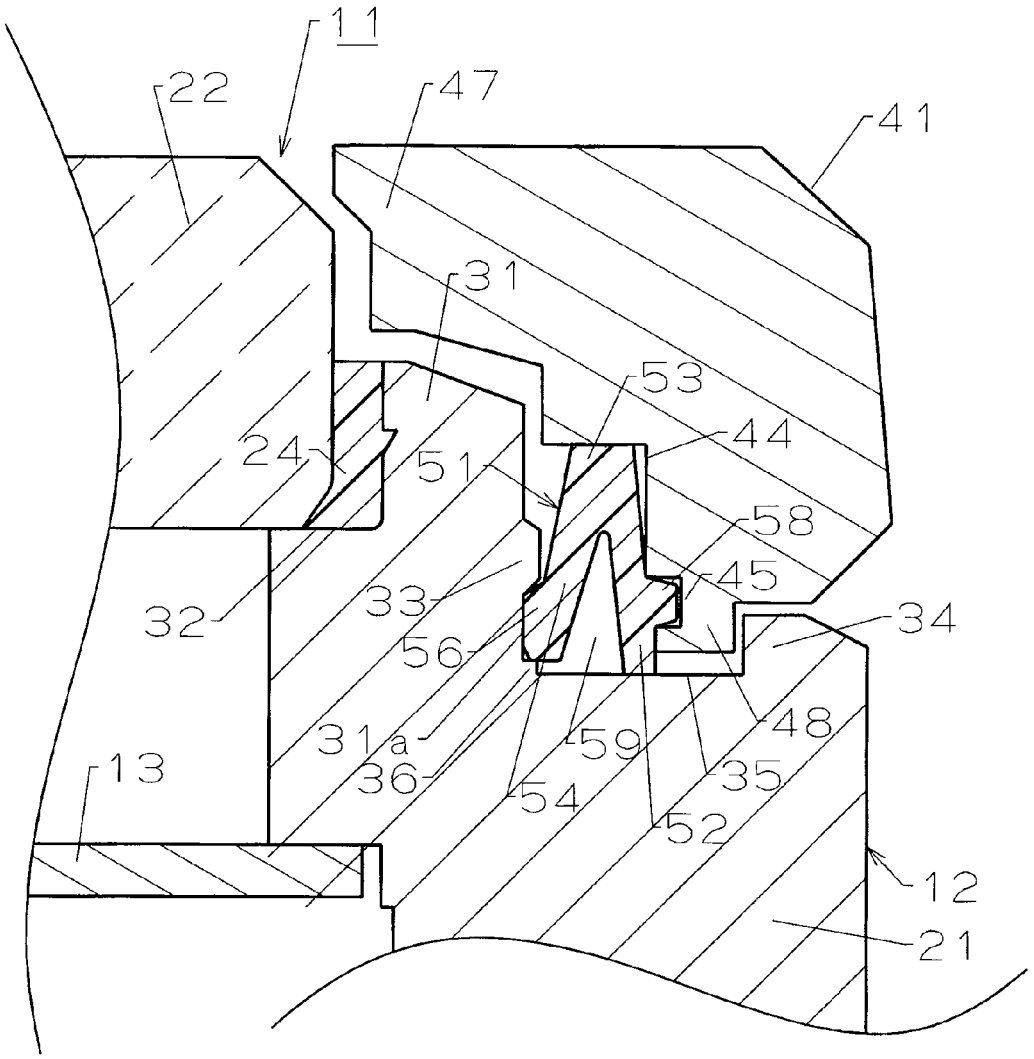
FIG. 8 is a cross-sectional view showing a bezel mounting structure of a watch according to a second embodiment of the present invention.
Figure 9:
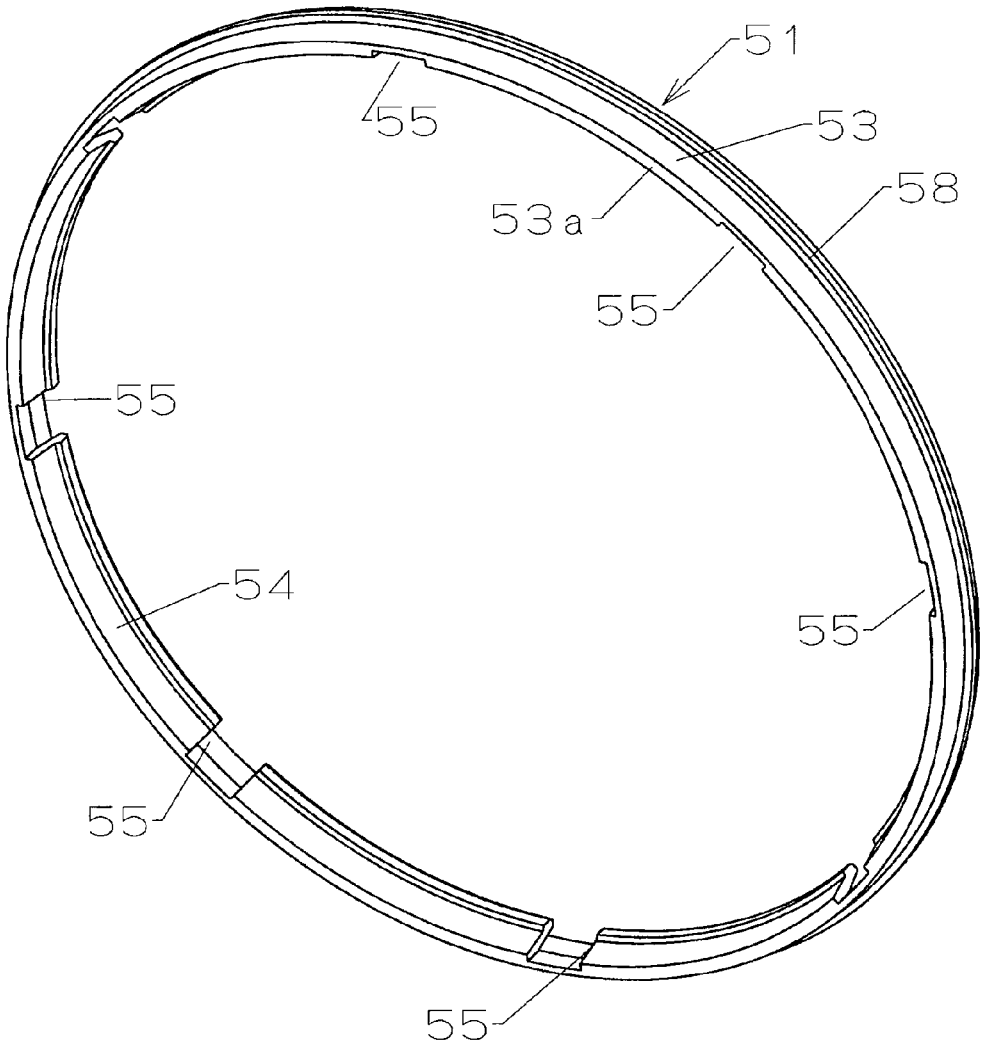
FIG. 9 is a perspective view corresponding to FIG. 7, showing a mounting member included in the watch according to the second embodiment.

FIG. 8 and FIG. 9 show a second embodiment of the present invention. Since components of the second embodiment are the same as those of the first embodiment except the following explanation, the same components or components having the same functions as the first embodiment are denoted by the same reference numerals as the first embodiment and the explanation thereof is omitted.

In the second embodiment, the holes of the bezel 41 and the projections 57 of the mounting member 51 to be fitted to the holes explained in the first embodiment are omitted. Therefore, the bezel 41 and the mounting member 51 which is not adhered thereto can slide and move relatively in the circumferential direction. Components other than the components explained above are the same as those of the first embodiment including components not shown in FIG. 8 and FIG. 9.

Accordingly, the problems of the present invention can be solved also in the second embodiment due to the reason explained in the first embodiment. Additionally, the fitting concave portion 45 of the bezel 41 and the fitting convex portion 58 of the mounting member 51 that is not fixed to the bezel 41 by an adhesive can slide at the convexo-concave fitting portion between them. Accordingly, when the mounting member 51 is rotated following the rotatively-operated bezel 41, the mounting member 51 is allowed to be rotated at a different angle from the rotation angle of the bezel 41.

Figure 10:
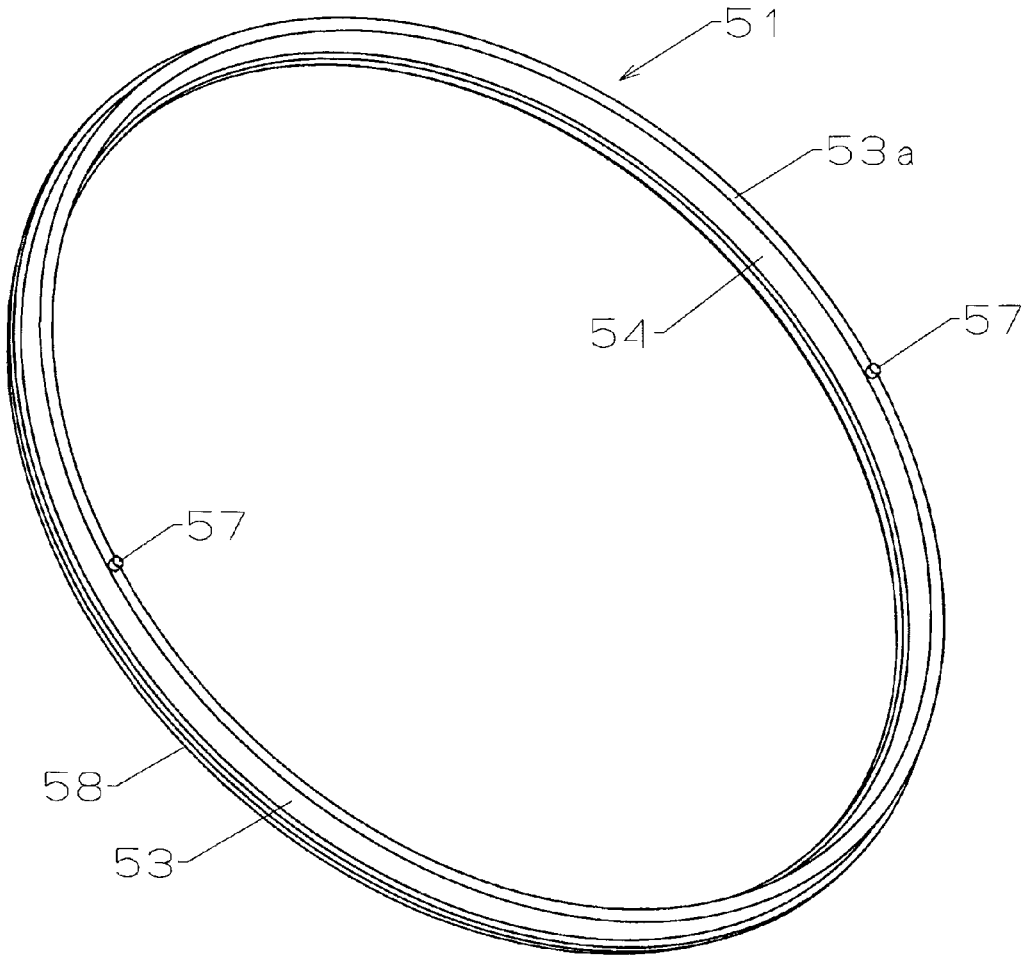
FIG. 10 is a perspective view corresponding to FIG. 7, showing a mounting member included in a watch according to a third embodiment of the present invention.

FIG. 10 shows a third embodiment of the present invention. Since components of the third embodiment are the same as those of the first embodiment except the following explanation, the same components or components having the same functions as the first embodiment are denoted by the same reference numerals as the first embodiment and the explanation thereof is omitted.

In the third embodiment, the inner peripheral portion 54 of the mounting member 51 is not divided into plural portions and is continuously formed around the circumference in the circumferential direction. Other components are the same as those of the first embodiment including components not shown in FIG. 10.

Accordingly, the problems of the present invention can be solved also in the third embodiment due to the reason explained in the first embodiment.

Figure 11:
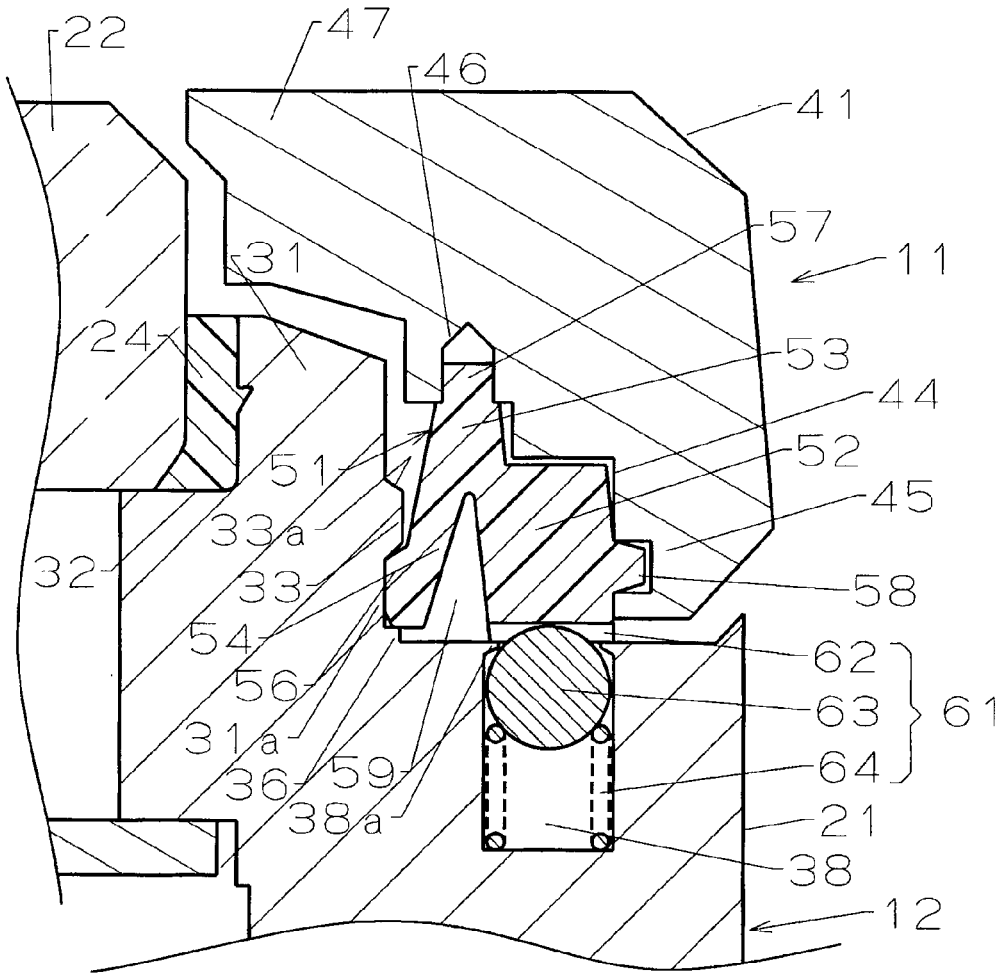
FIG. 11 is a cross-sectional view corresponding to FIG. 3, showing a watch according to a fourth embodiment of the present invention.
Figure 12:
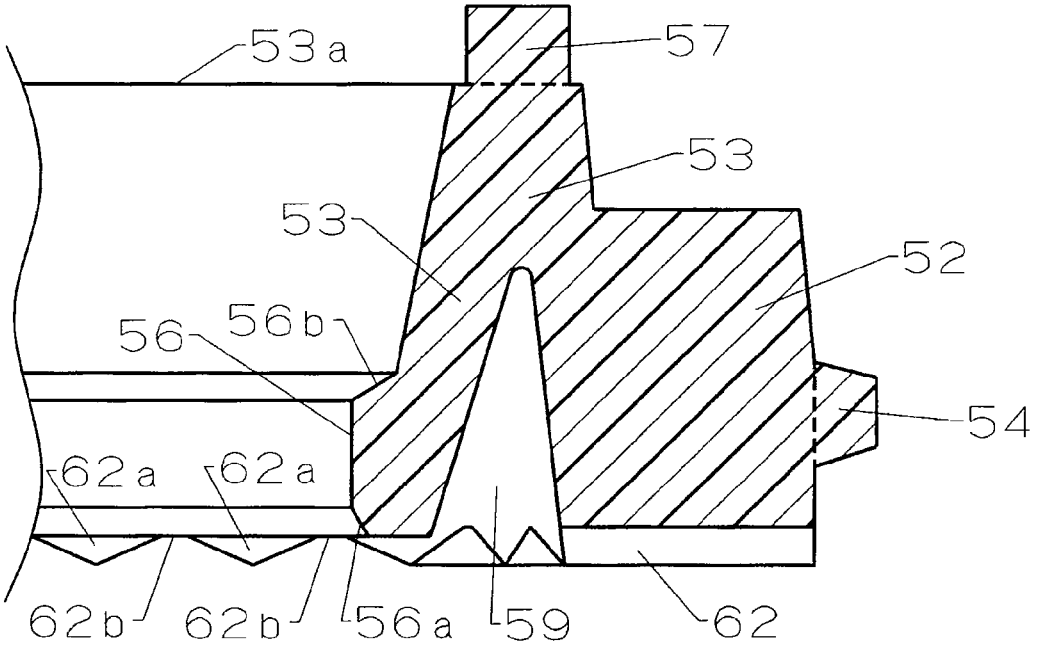
FIG. 12 is a cross-sectional view showing part of a mounting member included in the watch of FIG. 11.

FIG. 11 and FIG. 12 show a fourth embodiment of the present invention. Since components of the fourth embodiment are the same as those of the first embodiment except the following explanation, the same components or components having the same functions as the first embodiment are denoted by the same reference numerals as the first embodiment and the explanation thereof is omitted.

The watch 11 according to the fourth embodiment further includes a click stop means 61 for holding the bezel 41 at an arbitrary rotation position, in which the insertion convex portion of the bezel 41 and the convex portion of the shell 21 explained in the first embodiment are omitted.

As shown in FIG. 11, the click stop means 61 includes, for example, a click engaging portion 62, a click member 63 and a coil spring 64.

The click engaging portion 62 is formed at an end surface of the outer peripheral portion 52 that contacts the bottom surface of the concave groove 35 provided in the shell 21 as shown in FIG. 12. The click engaging portion 62 is formed by plural projections and depressions alternately arranged in the circumferential direction of the mounting member 51. Each convex portion 62*a* (refer to FIG. 12) of the click engaging portion 62 has a triangle shape which protrudes toward the bottom surface of the concave groove 35 in a tapered manner. Additionally, each concave portion 62*b* (refer to FIG. 12) of the click engagement portion 62 formed between adjacent triangle convex portions 62*a* is widened toward the bottom surface of the concave groove 35.

As shown in FIG. 11, an accommodating groove 38 opening to the bottom surface of the concave groove 35 is formed in the shell 21. The accommodating groove 38 is formed, for example, by a circular vertical hole. The click member 63 and the coil spring 64 are accommodated inside the accommodating groove 38.

The click member 63 is made of, for example, a steel ball. The click member 63 can move in the axial direction of the accommodating groove 38 and is prevented from falling off from the accommodating groove 38 by an opening edge portion 38*a* narrowing the opening of the accommodating groove 38. The coil spring 64 biases the click member 63 with the elastic force thereof. The biasing makes part of the click member 63 protrude from the accommodating groove 38, and a protrusion is pressed onto the click engaging portion 62.

The protrusion of the click member 63 can be engaged with and disengaged from the click engaging portion 62 freely, and the bezel 41 is held so as not to rotate improperly by the engagement. As the bezel 41 is rotatively operated, the click member 63 is pressed by the convex portions 62*a* of the click engaging portion 62 as well as pushed into the accommodating groove 38 against the biasing force of the coil spring 64. Accordingly, the click member 63 is disengaged from the click engaging portion 62, therefore, the rotation operation of the bezel 41 is maintained. Just after that, the click member 63 is pressed to the concave portions 62*b* of the click engaging portion 62 by the biasing force of the coil spring 64, thereby engaging the click engaging portion 62 with the click member 63.

Therefore, when the user stops rotation operation in a state where the bezel 41 is rotated at an arbitrary angle, the bezel 41 can be held at a position (arbitrary position) where the rotation operation of the bezel 41 is stopped by the click stop means 61. As the engagement/disengagement between the click member 63 and the click engaging portion 62 are repeated with the rotation operation of the bezel 41, the sense of moderation can be given with percussive noise caused by the engagement/disengagement.

In the fourth embodiment, the mounting member 51 is rotated at the same rotation angle as the bezel 41 by the fitting between the projections 57 and the holes 46. In the watch 11 according to the fourth embodiment, the mounting member 51 doubles as part of the click stop member 61 as described above. Accordingly, the positional relationship between indications added to the surface of the bezel 41 and the click engaging portion 62 is not misaligned regardless of the rotation operation of the bezel 41.

Components other than the components explained above in the fourth embodiment are the same as those of the first embodiment including components not shown in FIG. 11 and FIG. 12.

Therefore, the problems of the present invention can be solved also in the fourth embodiment due to the reason explained in the first embodiment.

What is claimed is:

1. A timepiece comprising:

a case including an annular shell having an outer peripheral wall and an engaging projection formed in a circumferential direction on the outer peripheral wall of the annular shell, the engaging projection having a first engagement surface;

a ring-shaped bezel having an inner peripheral wall circumferentially surrounding the outer periphery wall of the annular shell, the ring-shaped bezel being arranged for circumferential rotation around the outer periphery wall of the annular shell and for separation from the annular shell in a first axial direction; and a ring-shaped mounting member formed of an elastic material and positioned between the outer peripheral wall of the annular shell and the inner peripheral wall of the ring-shaped bezel, the ring-shaped mounting member including (i) an outer peripheral portion being in contact with the inner peripheral wall of the ring-shaped bezel, (ii) an inner peripheral portion being in contact with the outer peripheral wall of the annular shell, and (iii) an annular groove formed between the outer and inner peripheral portions of the ring-shaped mounting member, wherein the annular groove is elastically deformable to become narrower or wider to cause the inner peripheral portion of the ring-shaped mounting member to move in radial directions close to and away from the outer peripheral portion thereof, the ring-shaped mounting member further includes an engaging portion formed in the inner peripheral portion of the ring-shaped mounting member, the engaging portion having a second engagement surface configured to engage with the first engagement surface of the engaging projection of the annular shell to restrict the ring-shaped bezel from moving relative to the annular shell in the first axial direction to prevent the ring-shaped bezel from separating from the annular shell, and the first and second engagement surfaces are in tapered contact with each other so that the engaging portion of the ring-shaped mounting member is disengageable from the engaging projection of the annular shell when the ring-shaped mounting member is pulled in the first axial direction away from the annular shell with a sufficient force, which is converted by the tapered contact between the first and second engagement surfaces into a radial force to move the inner peripheral portion of the ring-shaped mounting member towards the outer peripheral portion thereof and cause the second engagement surface of the engaging portion to slide along the first engagement surface of the engaging projection and over the engagement projection to release ring-shaped bezel from the annular shell.

2. The timepiece according to claim 1, wherein the ring-shaped mounting member includes plural grooves formed in a radial direction in the inner peripheral portion of the ring-shaped mounting member and communicated to the annular groove thereof, so that the plural grooves divide the inner peripheral portion into plural sections arranged in series in the circumferential direction.

3. The timepiece according to claim 1, wherein the inner peripheral wall of the bezel and the outer peripheral portion of the ring-shaped mounting member have a circumferential groove and a circumferential elevation formed, respectively, therein, and the circumferential elevation is fitted in the circumferential groove to restrict the ring-shaped mounting member from moving in the first axial direction relative to the ring-shaped bezel.

4. The timepiece according to claim 3, wherein the ring-shaped bezel and the ring-shaped mounting member have a hole and a key formed, respectively, therein, and the key is fitted in the hole to restrict the ring-shaped mounting member from moving in the circumferential direction relative to the ring-shaped bezel.

5. The timepiece according to claim 4, further comprising a click stop mechanism configured to hold the bezel in an arbitrary rotation position with respect to the annular shell, wherein the click mechanism includes (i) teeth formed in the ring-shaped mounting member in series in the circumferential direction, and (ii) a stopper provided in the annular shell and urged against between adjacent two of the teeth to releasably restrict the ring-shaped bezel from moving in the circumferential direction with respect to the annular shell.

* * * * *